US008600095B2

(12) United States Patent
Yuen

(10) Patent No.: US 8,600,095 B2
(45) Date of Patent: Dec. 3, 2013

(54) EARPHONE WITH A MOVABLE PUSH ROD STRUCTURE

(75) Inventor: Shunming Yuen, Shenzhen (CN)

(73) Assignee: Innovation Sound Technology Co., Ltd., Fuyong Town, Baoan, Shenzhen (CN)

( * ) Notice: Subject to any disclaimer, the term of this patent is extended or adjusted under 35 U.S.C. 154(b) by 342 days.

(21) Appl. No.: 13/001,784

(22) PCT Filed: Dec. 24, 2008

(86) PCT No.: PCT/CN2008/073697

§ 371 (c)(1),
(2), (4) Date: Dec. 28, 2010

(87) PCT Pub. No.: WO2010/072027

PCT Pub. Date: Jul. 1, 2010

(65) Prior Publication Data

US 2011/0103637 A1 May 5, 2011

(51) Int. Cl.
*H04R 1/10* (2006.01)

(52) U.S. Cl.
USPC ..... 381/380; 381/87; 381/386; 381/395

(58) Field of Classification Search
USPC ..... 381/380, 375, 386, 395, 87
See application file for complete search history.

(56) References Cited

U.S. PATENT DOCUMENTS

2008/0226114 A1* 9/2008 Thompson et al. ..... 381/380
2009/0116677 A1* 5/2009 Jones et al. ..... 381/380
2010/0246878 A1* 9/2010 Sim et al. ..... 381/380

FOREIGN PATENT DOCUMENTS

WO PCT/CN2008/073697 10/2010

* cited by examiner

*Primary Examiner* — Duc Nguyen
*Assistant Examiner* — Phan Le
(74) *Attorney, Agent, or Firm* — Global IP Services; Tianhua Gu

(57) ABSTRACT

This invention relates to an earphone with a movable push rod structure, which comprising a housing, a sound-emitting unit assembled inside of the housing, and a sound duct connected to the sound-emitting unit for sound transmission, and an earplug connected to the sound duct, with an air duct assembled on the housing for the flow of air inside and outside the earphone, as well as a movable push rod assembled inside the housing and connected with the housing for adjusting air flow condition of the air duct. A completely sealed earphone can be achieved when the push rod is pushed to block the air duct, or an open earphone can be achieved when the push rod is separated from the air duct. This invention has advantages of convenient and flexible regulation of sound modes of the earphones, which can be applied to users who have different requirements for sounds, and also a broader range of applications.

4 Claims, 8 Drawing Sheets

EARPHONE WITH A MOVABLE PUSH ROD STRUCTURE

CROSS REFERENCE TO RELATED PATENT APPLICATION

This patent application is the US national stage of PCT/CN2008/073697 filed on Dec. 24, 2008, which application is incorporated herein by reference.

FIELD OF THE INVENTION

This invention relates to an earphone device, and more specifically, an earphone with a movable push rod structure.

BACKGROUND OF THE INVENTION

Generally for small-size earphones, some of which need to be in completely sealed form, while some of which need completely open design. It is well known that, in earphones, sounds corresponding to audio signals are usually generated through vibration of the diaphragm of sound-emitting unit 4 in the earphone based on audio signals from players such as MP3, as well as change of compression state of air. Therefore, the air flow inside and outside the earphone will directly affect the frequency of sound generated, so it will also affect the quality of sound heard. In acoustic playing, 50-500 Hz acoustic signal is commonly referred to as mid-low frequency signal, which is different from the frequency range of the human voice, and covers musical instruments in the symphony instrument group for vehemence, such as drum, cello and so on. When mid-low frequency is missing, music will be insipid. When too much mid-low frequency is filling, music will be boring. However appropriate mid-low frequency can greatly attract audience.

A completely sealed earphone has advantages of low distortion, low sound leakage and low technological requirements, but its low-frequency reproducibility is relatively low. A completely open earphone has advantage of easy adjusting for acoustic manifestation, but it also has relatively high distortion and very serious sound leakage, and can not be used in a silent room. In reality, when earphones are used on different occasions by different users, different requirements for the sealed form and the open form are put forward. Now, in the newest types of earphones, replaceable air ducts are used to change the mid-low frequency, but the drawbacks are that air ducts for replacement require precise skills, the replacement time is too long, and the air duct is easily lost due to its small size.

SUMMARY OF THE INVENTION

One aspect of the present invention is providing an earphone with a movable push rod structure which is used to make conversion between a sealed form and an open form of the earphone more flexible and convenient for easy selection of different sound modes, so as to solve the technical problems of above-mentioned difficulties in conversion between the sealed form and open form of the same earphone and disadvantages of inconvenient replacement and high technological requirements in existing arts.

The technical scheme adopted in this invention to solve above technical problems is that constructing an earphone with a movable push rod structure, which comprising a housing, a sound-emitting unit 4 assembled inside the housing, and a sound duct connected to sound-emitting unit 4 for sound transmission, and an earplug connected to the sound duct, wherein, an air duct is assembled on the housing for flow of air inside and outside the earphone, and a movable push rod is assembled inside the housing and connected with the housing for adjusting air flow condition of the air duct.

In the earphone with a movable push rod structure according to this invention, the air duct locates on the housing of one side of a cavity formed by the sound duct and the sound-emitting unit 4.

In the earphone with a movable push rod structure according to this invention, there is a protruding slide rail assembled on the inner wall of the housing.

In the earphone with a movable push rod structure according to this invention, there is a groove on one side of the housing.

In the earphone with a movable push rod structure according to this invention, the push rod is L-shape.

In the earphone with a movable push rod structure according to this invention, a bulge is arranged on one side of the L-shape push rod along the direction perpendicular to the groove, wherein, the one side is close to the groove, and on the other side of the L-shape push rod, there is a block extending along the direction parallel to the groove for sealing the air duct.

In the earphone with a movable push rod structure according to this invention, the block is perpendicular to the air duct.

In the earphone with a movable push rod structure according to this invention, the area of the block's surface that close to the air duct is larger than the cross-sectional area of the air duct.

In the earphone with a movable push rod structure according to this invention, there is a notch on the bulge, and the size of the notch matches the groove, and the push rod slides through the notch along the groove and the slide rail.

The earphone with a movable push rod structure according to this invention also comprises a switch, which is located in the groove of the housing, and connected with the bulge in a fixed manner for sliding the push rod.

In application of the earphone with a movable push rod structure according to this invention, as the push rod is movable, it can slide along the groove on the housing of the earphone and the slide rail inside the housing, so that it can completely block the air duct or be separated from the air duct to adjust the flow of air inside and outside the earphone, so the frequency of sounds in the earphone can be further adjusted. In this invention, the earphone can be adjusted, balanced, separated and sealed flexibly and conveniently through pushing the movable push rod and the air duct, so as to select the sound modes of the earphone easily for outputting sounds in different frequencies.

BRIEF DESCRIPTION OF THE DRAWINGS

This invention will be further illustrated through attached drawing and embodiments as follows. In the drawings.

DETAILED DESCRIPTION OF THE PREFERRED EMBODIMENT

In the earphone provided by this invention, the aeration condition in the air duct 31 is mainly controlled by the movable push rod 2, so as to control the sound frequency and effect.

Figure 1A:
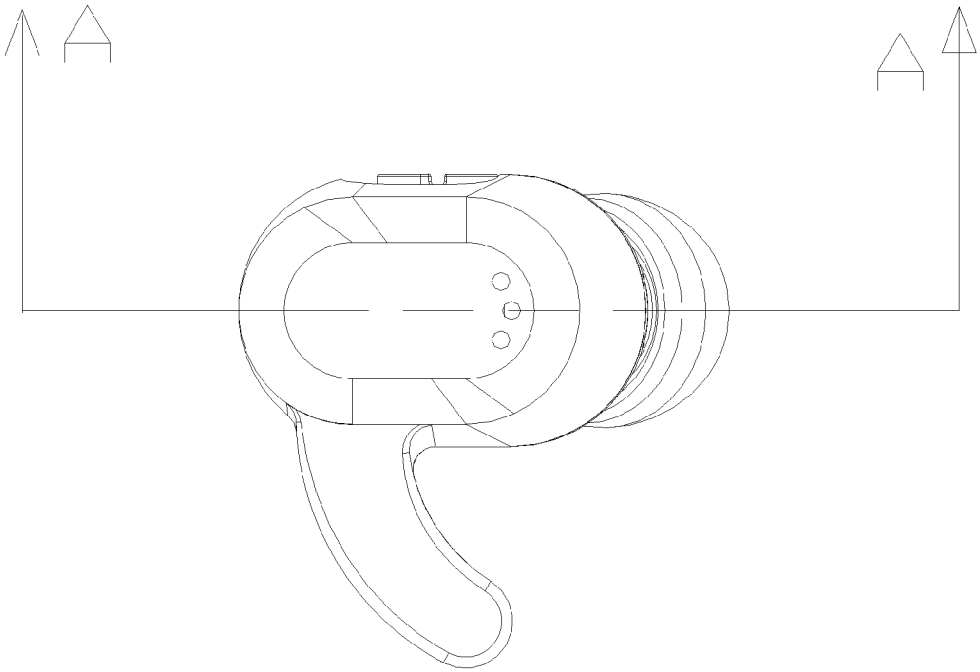
FIG. 1*a* is a stereogram of the earphone with a movable push rod structure according to this invention when the air duct is sealed by the push rod.
Figure 1B:
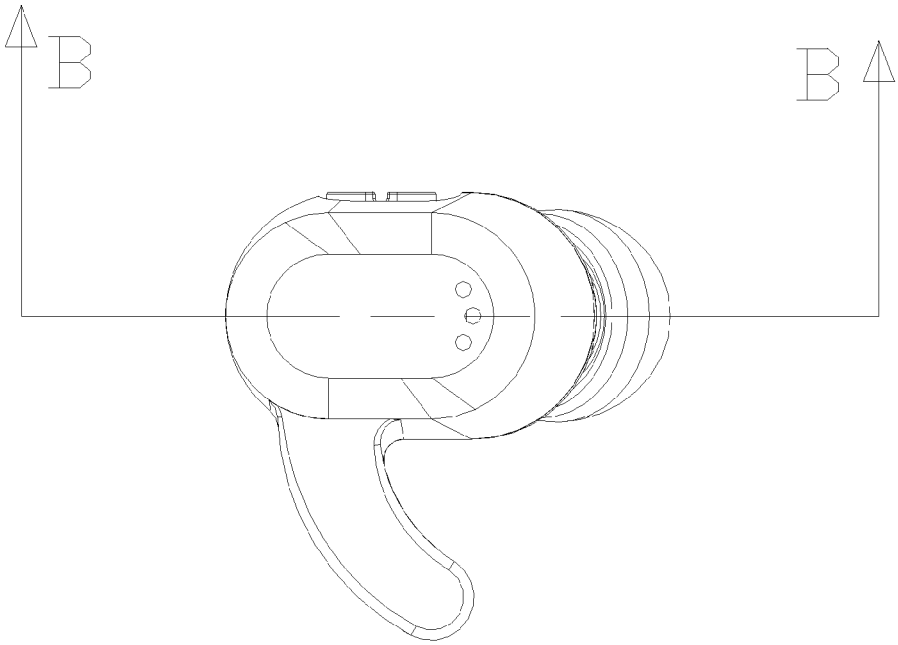
FIG. 1*b* is a stereogram of the earphone with a movable push rod structure according to this invention when the air duct is completely separated from the push rod.
Figure 2A:
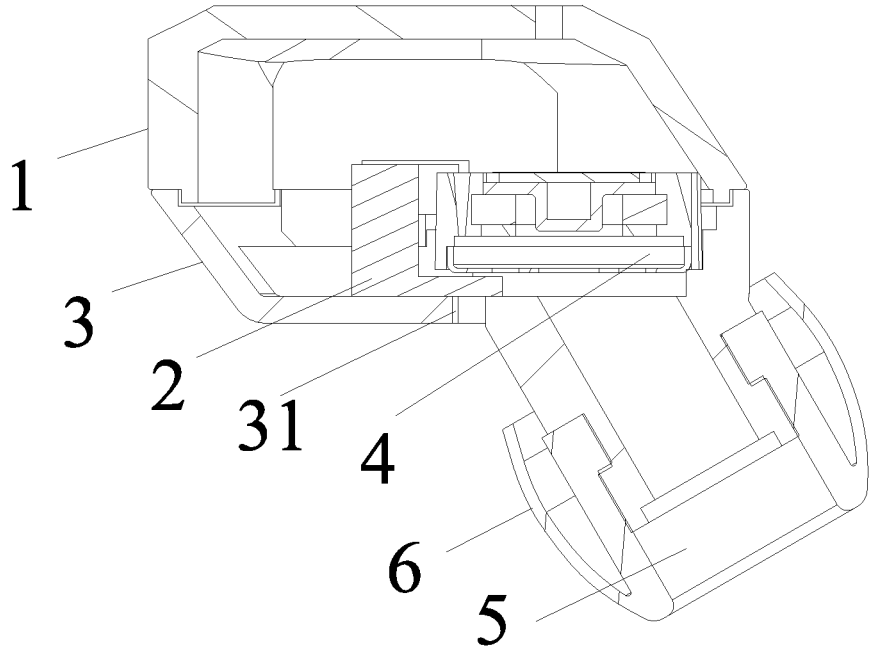
FIG. 2*a* is a sectional view of FIG. 1*a* along A-A line.
Figure 2B:
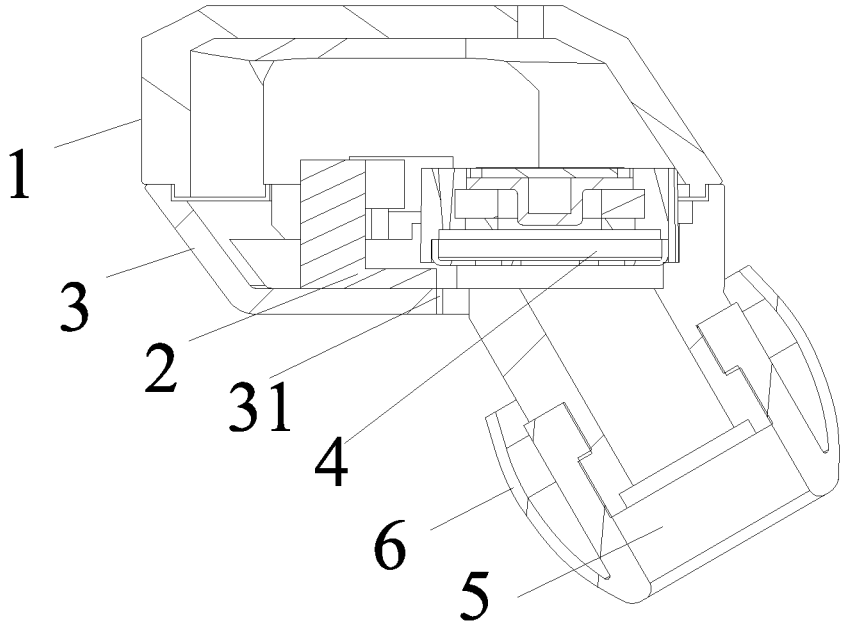
FIG. 2*b* is a sectional view of FIG. 2*b* along B-B line.
Figure 3:
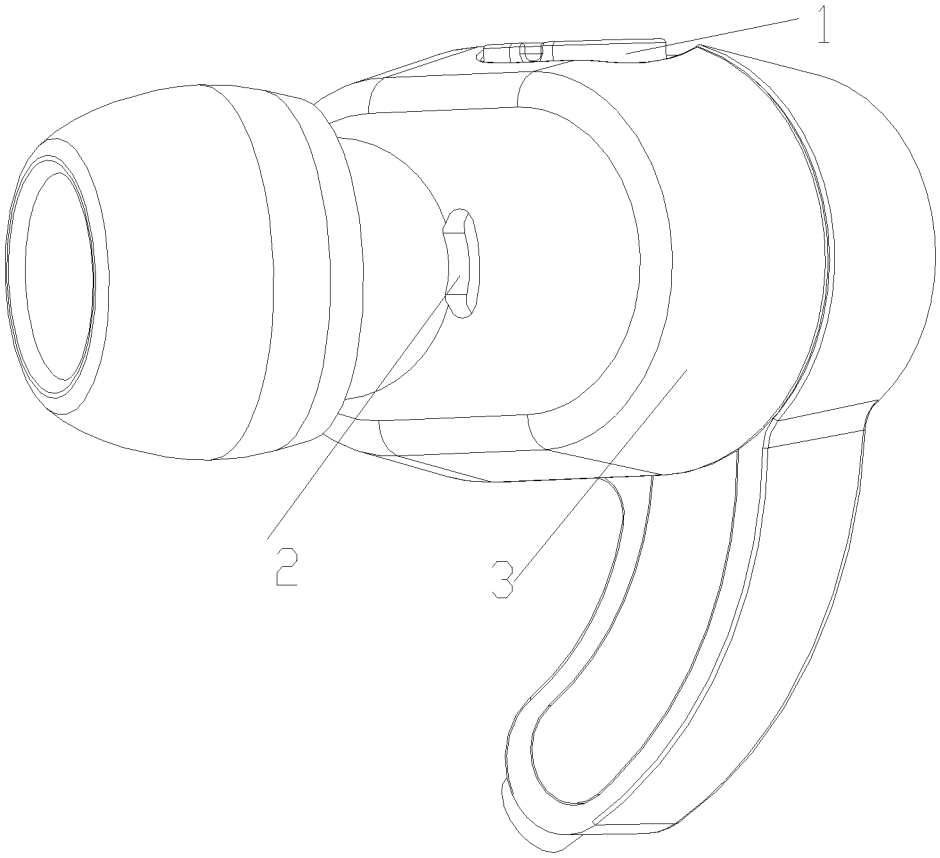
FIG. 3 is another stereogram of the earphone with a movable push rod structure according to this invention.
Figure 4:
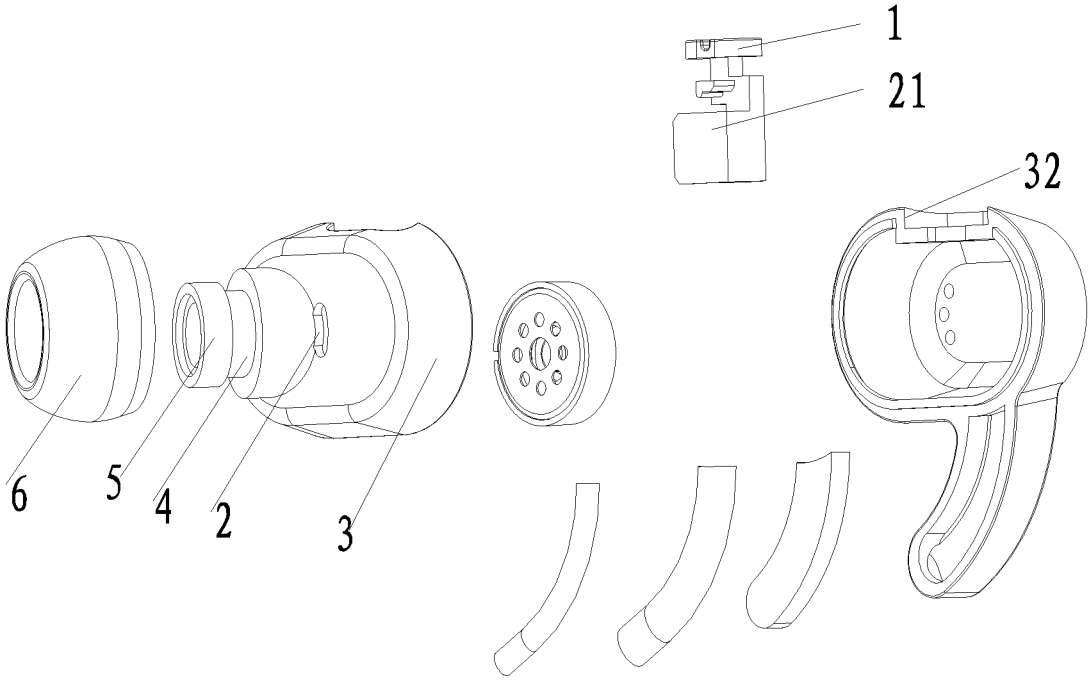
FIG. 4 is an exploded view corresponding to FIG. 3.
Figure 5:
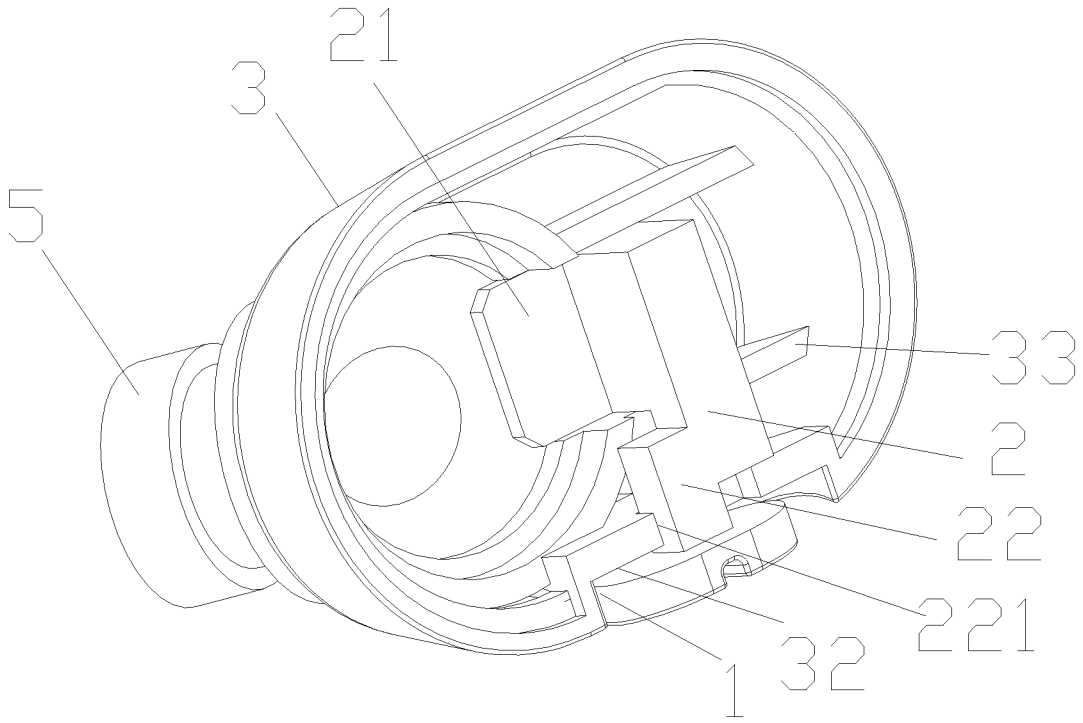
FIG. 5 is an isometric view of the earphone with a movable push rod structure according to this invention.
Figure 6:
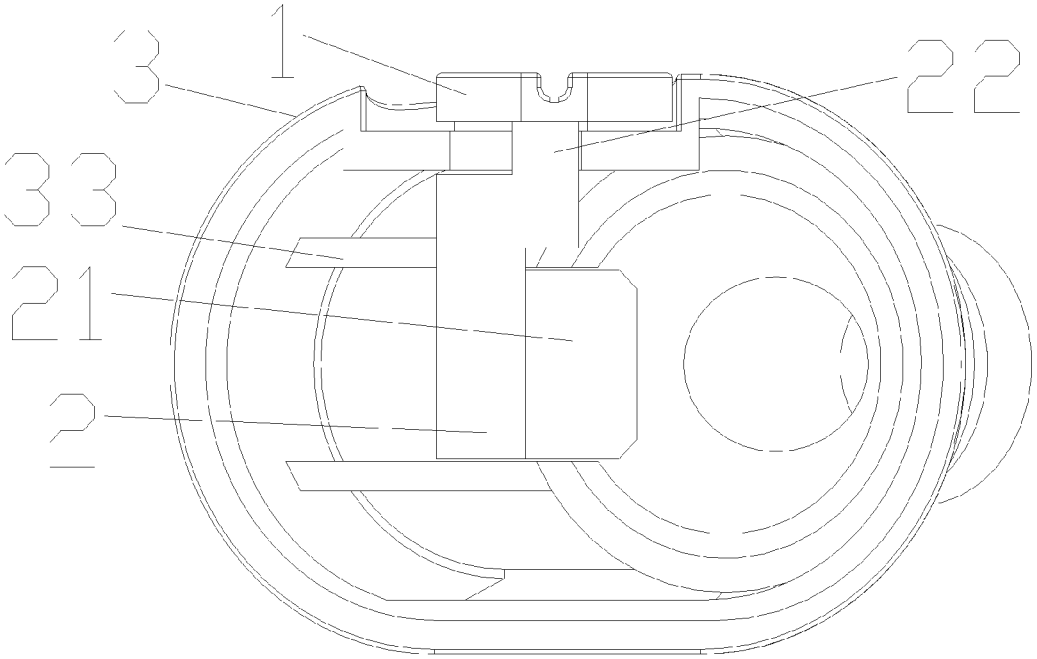
FIG. 6 is a top view of one embodiment of the earphone with a movable push rod structure according to this invention.

Take FIG. 1*a* to FIG. 6 for reference. FIG. 1*a* and FIG. 1*b* are stereograms according to this invention. FIG. 2*a* and FIG. 2*b* is respectively a sectional view of FIG. 1*a* and FIG. 1*b* along the line. FIG. 3 is a stereogram of one embodiment according to this invention. FIG. 4 is an exploded view corresponding to FIG. 3. FIG. 5 is an isometric view according to this invention. FIG. 6 is a top view of one embodiment of the earphone with a movable push rod structure according to this invention.

It is known from figures above that this invention comprises housing 3, speaker sound-emitting unit 4 assembled in housing 3, sound duct 5 connected to the sound-emitting unit 4 for transmitting sound from the sound-emitting unit 4, earplug 6 assembled at the end of the sound duct 5, and a cavity formed between the sound duct 5 and the sound-emitting unit 4. On one side of the cavity, an air duct 31 is arranged on housing 3 close to the cavity. The air duct 31 penetrates through housing 3 and can be various shapes, wherein cylinder is preferable. Air inside and outside the earphone can flow through air duct 31, and the flow of the air can change the sound frequency in the earphone so as to change the sound quality. Protruding slide rail 33 is also assembled on the inner wall of housing 3. When moving, the push rod 2 can move along the slide rail 33.

On one side of housing 3, there is a groove 32, which is a long and transverse groove along housing 3. Switch 1 is arranged in groove 32 and fixedly connected with the bulge 22 for pushing push rod 2. On the outward surface of switch 1, there is a notch, by which users can push the switch. Advantagely, the outward surface of switch 1 is flush arranged with the surface of the housing so as to prevent the misoperation caused by users' accidentally touching of the switch.

Inside of housing 3, there is also a movable push rod 2 of L-shape. One side of the movable push rod 2 close to groove 32 is parallel to or approximately parallel to groove 32. Bulge 22 is arranged at this side of the movable push rod 2 along the direction perpendicular to groove 32. Notch 221 is arranged on the bulge 22. The push rod 2 is connected with groove 32 in a slip manner through the notch 221. The push rod 2 also slides along groove 32 and slide rail 33 through the notch 221. The size of the notch 221 matches the size of the groove 32 for better slip connection to groove 32. On the other side of push rod 2, a block 21 extends along the direction parallel to groove 32. When push rod 2 is pushed by switch 1, the block 22 is used to seal air duct 31, so as to prevent sound from flowing out of the earphone, and also to prevent air and sound outside from flowing into the earphone. Or when push rod 2 is moved, the block 21 can be separated from air duct 31 for interchange of air inside and outside the earphone. For effectively sealing air duct 31, block 21 is preferable to perpendicular to air duct 31, and the area of the side of block 21 close to the air duct is larger than the cross-sectional area of air duct 31.

When switch 1 is pulled to one side of groove 32, air duct 31 can be completely blocked by push rod 2, and then inner cavity of the earphone can be completely sealed, so that completely sealed form of sound mode can be selected in the earphone for implementing of low sound leakage and low distortion. Therefore, people can be totally immersed in melody of the music without interruption when they want to be isolated from sounds outside. When switch 1 is moved to the other side of groove 32, push rod 2 can be totally separated from air duct 31, and then inner cavity of the earphone can be completely open to the outside, so that completely open form of sound mode can be selected in the earphone for easier adjustment of sounds in various frequencies, such as mid-low frequency, which covers musical instruments in the symphony instrument group for vehemence, such as drum, cello and so on. When mid-low frequency is missing, music will be insipid. When too much mid-low frequency is filling, music will be boring. However appropriate mid-low frequency can greatly attract audience, and sounds from open earphones can be adjusted into an appropriate mid-low frequency.

Figure 7:
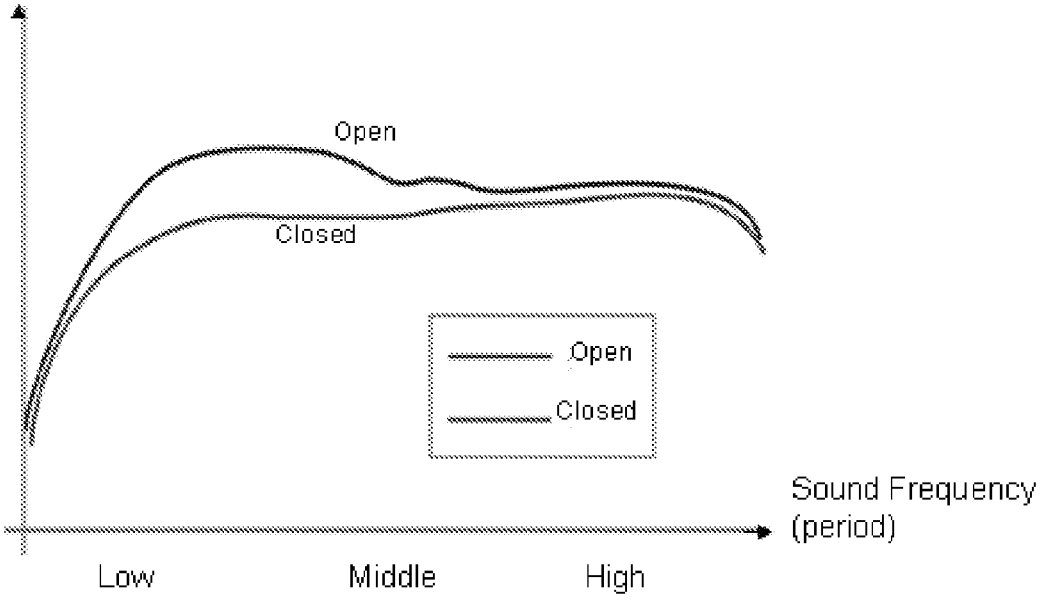
FIG. 7 is a variation diagram of sound in 50-500 Hz frequency in the earphone according to this invention when the movable push rod is separated from and seals the air duct.
Figure 8:
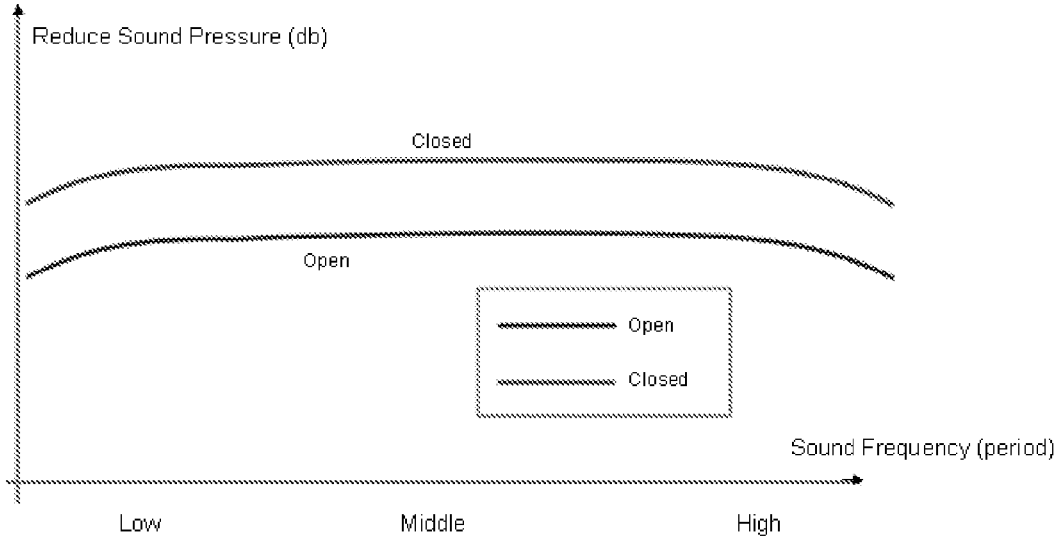
FIG. 8 is a concept diagram of db loss of the NRR of separated and sealed sound when the movable push rod according to this invention is separated from and seals the air duct.

FIG. 7 and FIG. 8 are for reference. FIG. 7 is a variation diagram of sound in 50-500 Hz frequency in the earphone according to this invention when movable push rod 2 is separated from the air duct and sealing the air duct. FIG. 8 is a concept diagram of db loss of NRR of separated and sealed sound when movable push rod 2 according to this invention is separated from air duct 31 and sealing air duct 31. FIG. 7 shows that when air duct 31 is opened by push rod 2, sounds in mid-low frequency in the earphone are better. Sound isolation is generally indicated by NRR index, which refers to the difference between volume (db) outside and the corresponding volume (db) heard. Generally, about 10-20 db can be isolated by a general sealed earphone with earplug 6. FIG. 8 shows that a good sound isolation can be achieved when push rod 2 is sealed by air duct 31 according to this invention.

In order to avoid air leakage, damping or sealing materials can be used in the joint of push rod 2 and housing 3. In this invention switch 1 can also be moved so as to enable push rod 2 to block a part of air duct 31 for selecting output sounds needed by users. When the earphone is wear on human ears, the human eardrum, syrinx and the earphone can form two different sound-emitting structures, i.e., completely sealed structure or air exchangeable structure.

In conclusion, this invention can be operated by single hand. Switch 1 is used to drive push rod 2 to selectively block air duct 31 for balanced isolation and sealing effect, as well as requirements of controlling mid-low frequency in acoustics playing. Therefore, in this invention it is flexible and easy to select different sound modes of the earphone to output sounds in different frequencies. Moreover, operation of selecting sealed and open forms is easy and convenient, which can meet requirement of more users, and present invention also has a broader range of applications.

What mentioned above are only preferable embodiments of this invention, which are not to limit this invention. Any modification, equivalent replacement or improvement within the spirit and principles of this invention should be within the scope of protection of this invention.

What is claimed is:

1. An earphone with a movable push rod structure comprising: a housing, a sound-emitting unit assembled inside the housing, and a sound duct connected to the sound-emitting unit for sound transmission, and an earplug connected to the sound duct; an air duct is assembled on the housing for flow of air inside and outside the earphone; and a movable push rod is assembled inside the housing and connected with the housing for adjusting air flow condition of the air duct; wherein the air duct is located on a place of the housing where is beside a cavity formed by the sound duct and the sound-emitting unit; wherein there is a groove on one side of the housing; wherein the push rod is L-shape; wherein a bulge is arranged on one side of the L-shape push rod along direction perpendicular to the groove; wherein, the one side is close to the groove, and on the other side of the L-shape push rod, there is a block extending along direction parallel to the groove for sealing the air duct; wherein an area of the block's surface that close to the air duct is larger than a cross-sectional area of the air duct; and wherein there is a notch on the bulge, and size of the notch matches the groove, and the push rod slides through the notch along the groove and a slide rail.

2. The earphone with a movable push rod structure according to claim 1, wherein there is a raised slide rail assembled in an inner wall of the housing.

3. The earphone with a movable push rod structure according to claim 1, wherein the block is perpendicular to the air duct.

4. The earphone with a movable push rod structure according to claim 1, wherein the earphone with a movable push rod structure also comprises a switch, which is located in the groove of the housing, and connected with the bulge in a fixed manner for sliding the push rod.

* * * * *